US011661241B2

(12) United States Patent
Wilen et al.

(10) Patent No.: US 11,661,241 B2
(45) Date of Patent: May 30, 2023

(54) SYSTEM AND METHOD FOR CONCEALING PRINTED MATTER

(71) Applicant: WILopEN Products LC, Deerfield Beach, FL (US)

(72) Inventors: Corey Wilen, Farmingdale, NY (US); Gordon M. Kramer, Deerfield Beach, FL (US)

(73) Assignee: WILopEN Products LC, Deerfield Beach, FL (US)

( * ) Notice: Subject to any disclaimer, the term of this patent is extended or adjusted under 35 U.S.C. 154(b) by 0 days.

(21) Appl. No.: 16/244,785

(22) Filed: Jan. 10, 2019

(65) Prior Publication Data

US 2019/0276189 A1 Sep. 12, 2019

Related U.S. Application Data

(60) Provisional application No. 62/616,255, filed on Jan. 11, 2018.

(51) Int. Cl.
*B65D 27/04* (2006.01)
*B42D 15/00* (2006.01)

(52) U.S. Cl.
CPC ..... *B65D 27/04* (2013.01); *B42D 15/00* (2013.01)

(58) Field of Classification Search
CPC ..... B42D 25/00; B65D 26/04; B65D 27/04
USPC ..... 283/901, 67, 87, 116
See application file for complete search history.

(56) References Cited

U.S. PATENT DOCUMENTS 3,126,211 A * 3/1964 Heiken ..... B42D 15/08 283/101
3,468,046 A * 9/1969 Makishima ..... B42D 25/351 283/901
3,675,948 A * 7/1972 Wicker ..... B42D 25/40 283/901
4,189,353 A * 2/1980 Harriman ..... B42D 15/085 283/901
5,401,032 A * 3/1995 Barnhart ..... A63F 1/02 273/293
5,953,170 A * 9/1999 Glancy ..... G09F 3/0294 283/72
6,481,753 B2 * 11/2002 Van Boom ..... B42D 25/29 283/901
6,709,018 B2 * 3/2004 Phillips ..... B65D 27/04 229/68.1

(Continued)

*Primary Examiner* — Kyle R Grabowski
(74) *Attorney, Agent, or Firm* — James David Johnson; Johnson & Martin, P.A.

(57) ABSTRACT

A concealment device, system, and method for concealing printed matter are described. The concealment device features a translucent colored material having a color that corresponds to a first color of printed matter that is configured inside or behind the concealment device so as to be positioned adjacent to and beneath the colored material. The printed matter is concealed when viewed through the colored material from outside the concealment device. The concealment device can be an envelope, a magazine, or a booklet. The concealment system includes the concealment device and a printed item that is coverable by the concealment device. The printed item includes printed matter having a first color that corresponds to a color of the colored material. The printed matter is not visible when viewed through the colored material from outside the concealment device.

22 Claims, 3 Drawing Sheets

(56) References Cited

U.S. PATENT DOCUMENTS

| | | | | |
|---|---|---|---|---|
| 6,916,047 | B2 * | 7/2005 | Jarvis | B42D 15/025 283/901 |
| 7,922,208 | B2 * | 4/2011 | Haas | B42D 15/085 283/72 |
| 8,287,004 | B2 * | 10/2012 | Rosen | B65D 27/04 283/901 |
| 2003/0137145 | A1 * | 7/2003 | Fell | G09F 3/0292 283/72 |
| 2008/0156855 | A1 * | 7/2008 | Sanchez | B65D 27/04 229/71 |

* cited by examiner

SYSTEM AND METHOD FOR CONCEALING PRINTED MATTER

CROSS-REFERENCE TO RELATED APPLICATIONS

This application is a nonprovisional application of and claims priority from U.S. provisional patent application Ser. No. 62/616,255 filed on Jan. 11, 2018. The foregoing application is incorporated in its entirety herein by reference.

FIELD OF THE INVENTION

The invention relates to devices, systems, and methods of mailing. More particularly, the invention relates to a concealment device that can be an envelope, magazine, or booklet having a translucent colored material that is capable of concealing printed matter that is positioned behind the colored material.

BACKGROUND

Direct mail advertising employs many strategies and gimmicks for enticing a recipient to open a direct mail advertisement envelope. Some of these strategies use techniques that encourage the recipient to open the envelope by providing a hint or clue printed on the outside of the envelope concerning the nature of contents inside the envelope. Other strategies use windows that display a certain predefined area of a document or printed materials arranged inside a pocket of the envelope so that printed matter on the predefined area of the document is visible through a window of the envelope. Such windows generally are made from plastic or glassine attached to an inside front surface inside of the pocket of the envelope to cover an aperture that extends through the front surface of the envelope.

Current envelopes and mailers do not have any means to display a first portion of printed matter in the predefined area so that it is visible through the window of the envelope while concealing a second portion of printed matter in the predefined area that is also within the boundaries of the window.

A need exists for an envelope, mailer, and package envelope or box that features a window constructed from a translucent colored material that is capable of concealing printed matter on a predefined area of an enclosed item. A need also exists for magazines and booklets featuring a translucent colored material that is capable of concealing printed matter on a predefined area positioned behind the colored material.

SUMMARY

The invention relates to a concealment device, system, and method for concealing printed matter. The concealment device features a translucent colored material having a color that corresponds to a first color of printed matter that is configured inside or behind the concealment device so as to be positioned adjacent to and beneath the colored material. The printed matter is concealed when viewed through the colored material from outside the concealment device. The concealment device can be an envelope, a magazine, or a booklet. The concealment system includes the concealment device and a printed item that is coverable by the concealment device. The printed item includes printed matter having a first color that corresponds to a color of the colored material. The printed matter is not visible when viewed through the colored material from outside the concealment device.

As mentioned above, the concealment device can be an envelope having a window capable of concealing a portion of printed matter that is positioned behind the window within a pocket of the envelope in a predefined area that is visible through the window from outside the envelope. In many embodiments, the envelope is a letter envelope but in other embodiments, the envelope may be a package envelope, a mailer, or a box. The envelope's window conceals printed matter printed on the predefined area of an enclosed item inserted into the pocket of the envelope. The window is made of colored material that is entirely or partially transparent. The printed matter is printed on the enclosed item in a color that corresponds to a color of the colored material so that, when the predefined area is aligned with the window, the color of the colored material, which matches the color of the printed matter, renders the printed matter invisible through the window. In exemplary embodiments, both the color of the colored material and the color of the printed matter printed on the predefined area of the enclosed item are red. In other embodiments, other colors may be used.

The concealment devices, systems, and methods described herein provide an advantage over traditional advertisements and direct mail envelopes, magazines, and booklets in that a recipient is enticed to open or otherwise manipulate the concealment device to uncover the printed item so that the concealed printed matter may be viewed or read. The concealment devices, systems, and methods described herein accomplish this advantage not only by the eye-catching color of the colored material but also because the colored material conceals some or all of the printed matter printed on a predefined area of the printed item when the printed item is arranged or configured behind the colored material so that the area or borders of the predefined area align with and correspond to the area or boundaries of the colored material. By concealing or hiding all or a portion of the printed matter positioned behind the colored material of the concealment device, the recipient's curiosity is piqued so that the recipient becomes more likely to open or uncover the concealment device to access the printed item for reading or viewing of the concealed printed matter.

The envelope with concealing window also provides an advantage over traditional envelopes used for advertising, greeting cards, or other purposes in that a first portion of printed matter printed in a color that is different from the color of the window remains visible through the window while a second portion of the printed matter that is printed in a color that is the same or nearly the same as the color of the window is rendered invisible so that it cannot be viewed through the window from outside the envelope.

Accordingly, the invention features a concealment device for covering and concealing printed matter. The concealment device features a translucent colored material having a color that corresponds to a first color of printed matter that is configured inside or behind the concealment device so as to be positioned adjacent to and beneath the colored material. The printed matter is concealed when viewed through the colored material from outside the concealment device.

In another aspect, the invention can feature a window, wherein the window includes the colored material that conceals the printed matter.

In another aspect, the invention can feature the printed matter being printed on a predefined area of the printed item.

In another aspect, the invention can feature the printed item being configurable so that the predefined area is viewable through the window when the printed item is covered by the concealment device.

In another aspect, the invention can feature the colored material being red and the first color of the printed matter also being red.

In another aspect, the invention can feature the printed matter further including at least a second color, wherein the at least second color is a color that is different than the color of the colored material. The at least second color is visible behind the colored material when viewed from outside the concealment device.

In another aspect, the invention can feature the printed matter being or including text, an image, or both. The printed matter is not visible through the colored material from outside the concealment device but is visible upon uncovering the concealment device from the printed item.

In another aspect, the invention can feature the concealment device being or including an envelope, a magazine, or a booklet.

The invention also features a system for concealing printed matter. The system features a concealment device that includes a translucent colored material and a printed item that is coverable by the concealment device. The printed item includes printed matter having a first color that corresponds to a color of the colored material. The printed matter is not visible when viewed through the colored material from outside the concealment device.

In another aspect, the invention can feature the concealment device including a window and the window includes the colored material that conceals the printed matter.

In another aspect, the invention can feature the printed matter being printed on a predefined area of the printed item.

In another aspect, the invention can feature the printed item being configurable so that the predefined area is viewable through the window when the printed item is covered by the concealment device.

In another aspect, the invention can feature the colored material being red and the first color of the printed matter also being red.

In another aspect, the invention can feature the printed matter further including at least a second color, wherein the at least second color is a color that is different than the color of the colored material. The at least second color is visible behind the colored material when viewed from outside the concealment device.

In another aspect, the invention can feature the printed matter being or including text, an image, or both. The printed matter is not visible through the colored material from outside the concealment device but is visible upon uncovering the concealment device from the printed item.

In another aspect, the invention can feature the concealment device being or including an envelope, a magazine, or a booklet.

A method of the invention can be used for concealing printed matter. The method includes the steps of: (a) providing a printed item that includes printed matter; and (b) covering the printed item using a concealment device that includes a translucent colored material, wherein the colored material includes a first color. The printed matter includes a color that corresponds to the first color of the colored material.

Another method of the invention can feature the concealment device including a window and the window including the colored material that conceals the printed matter.

Another method of the invention can feature the printed matter being printed on a predefined area of the printed item, wherein the printed item is configurable so that the predefined area is viewable through the window when the printed item is covered by the concealment device.

Another method of the invention can include at least one of the steps of: (c) uncovering the concealment device from the printed item to reveal the printed matter that was concealed beneath the colored material of the concealment device; and (d) removing the printed item from the concealment device to reveal the printed matter that was concealed beneath the colored material, wherein the concealment device is an envelope into which the printed item is insertable and removable.

Another method of the invention can feature the colored material being red and the first color of the printed matter also being red.

Another method of the invention can feature the printed matter further including at least a second color, wherein the at least second color is a color that is different than the color of the colored material. The at least second color is visible behind the colored material when viewed from outside the concealment device.

Unless otherwise defined, all technical terms used herein have the same meaning as commonly understood by one of ordinary skill in the art to which this invention belongs. Although methods and materials similar or equivalent to those described herein can be used in the practice or testing of the present invention, suitable methods and materials are described below. All publications, patent applications, patents and other references mentioned herein are incorporated by reference in their entirety. In the case of conflict, the present specification, including definitions will control.

DETAILED DESCRIPTION

Figure 1A:
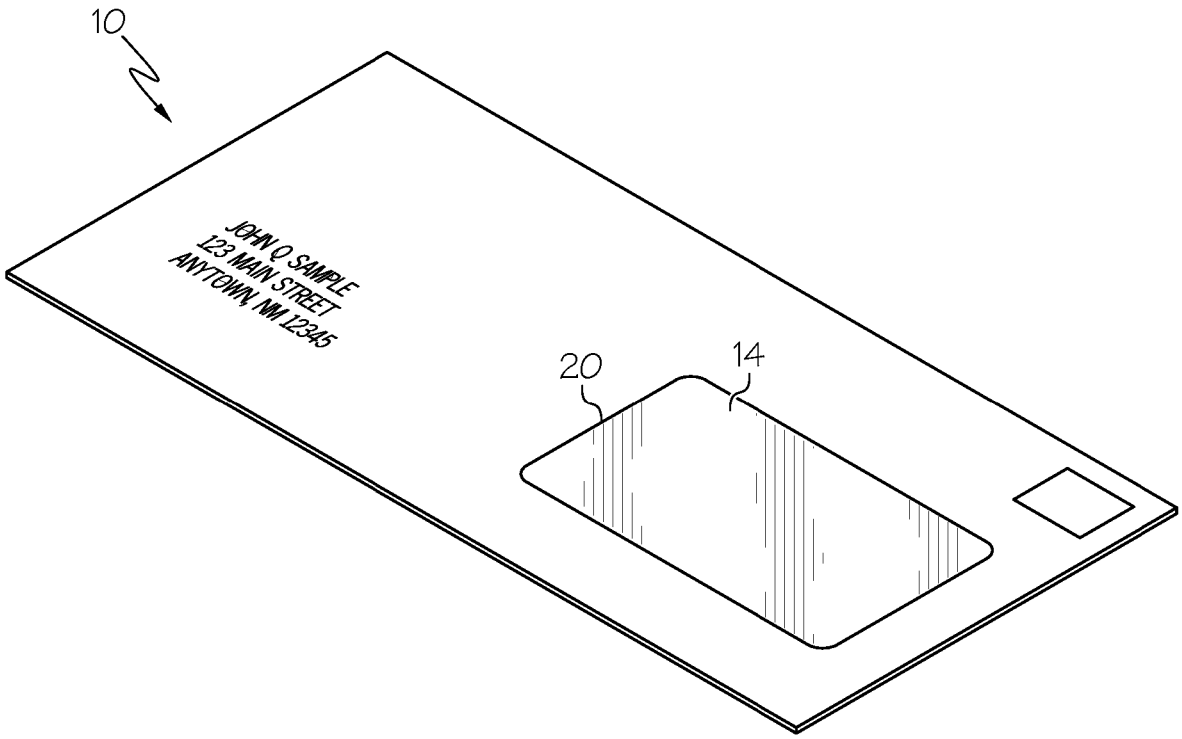
FIG. 1A is a perspective view of a concealment system, wherein the concealment device is an envelope with a window.

The present invention is best understood by reference to the detailed drawings and description set forth herein. Embodiments of the invention are discussed below with reference to the drawings; however, those skilled in the art will readily appreciate that the detailed description given herein with respect to these figures is for explanatory purposes as the invention extends beyond these limited embodiments. For example, in light of the teachings of the present invention, those skilled in the art will recognize a multiplicity of alternate and suitable approaches, depending upon the needs of the particular application, to implement the functionality of any given detail described herein beyond the particular implementation choices in the following embodiments described and shown. That is, numerous modifications and variations of the invention may exist that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

The present invention should not be limited to the particular methodology, compounds, materials, manufacturing techniques, uses, and applications, described herein, as these may vary. The terminology used herein is used for the purpose of describing particular embodiments only, and is not intended to limit the scope of the present invention. As used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" may be a reference to one or more steps or means and may include sub-steps and subservient means.

All conjunctions used herein are to be understood in the most inclusive sense possible. Thus, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should be read as "and/or" unless expressly stated otherwise. Structures described herein are to be understood also to refer to functional equivalents of such structures. Language that may be construed to express approximation should be so understood unless the context clearly dictates otherwise.

Unless otherwise defined, all terms (including technical and scientific terms) are to be given their ordinary and customary meaning to a person of ordinary skill in the art, and are not to be limited to a special or customized meaning unless expressly so defined herein.

Terms and phrases used in this application, and variations thereof, especially in the appended claims, unless otherwise expressly stated, should be construed as open ended as opposed to limiting. As examples of the foregoing, the term "including" should be read to mean "including, without limitation," "including but not limited to," or the like; the term "having" should be interpreted as "having at least"; the term "includes" should be interpreted as "includes but is not limited to"; the term "example" is used to provide exemplary instances of the item in discussion, not an exhaustive or limiting list thereof; and use of terms like "preferably," "preferred," "desired," "desirable," or "exemplary" and words of similar meaning should not be understood as implying that certain features are critical, essential, or even important to the structure or function of the invention, but instead as merely intended to highlight alternative or additional features that may or may not be utilized in a particular embodiment of the invention.

Those skilled in the art will also understand that if a specific number of an introduced claim recitation is intended, such an intent will be explicitly recited in the claim, and in the absence of such recitation no such intent is present. For example, as an aid to understanding, the appended claims may contain usage of the introductory phrases "at least one" and "one or more" to introduce claim recitations; however, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C" is used, in general, such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.).

All numbers expressing dimensions, quantities of ingredients, reaction conditions, and so forth used in the specification are to be understood as being modified in all instances by the term "about" unless expressly stated otherwise. Accordingly, unless indicated to the contrary, the numerical parameters set forth herein are approximations that may vary depending upon the desired properties sought to be obtained.

The invention relates to a concealment device 10 for covering and concealing printed matter 12. The concealment device 10 features a translucent colored material 14 having a color that corresponds to a first color of printed matter 12 that is configured inside or behind the concealment device so as to be positioned adjacent to and beneath the colored material. The printed matter 12 is concealed when viewed through the colored material 14 from outside the concealment device 10.

The colored material 14 is made from a material that is partially or entirely transparent or semi-opaque so as to be translucent. The colored material 14 can be paper, plastic, or foil (e.g., infrared foil). In exemplary embodiments, the colored material 14 can be glassine. The colored material 14 is sufficiently transparent so that printed matter that is different in color from the color of the colored material remains visible through the window. For example, if the window is red, printed matter printed on the enclosed item's predefined area in black ink remains visible through the window while printed matter printed in red ink on the predefined area is concealed and rendered invisible when looking at the window from outside the envelope. In the most exemplary embodiments, the colored material can be red in color and the printed matter that is to be concealed correspondingly is also red in color. In addition to red, other preferred colors for other exemplary embodiments include magenta and violet. In other embodiments, the colored material and the printed matter that is to be concealed by the concealment device may both be any color in the color spectrum, for example, orange, yellow, green, blue, indigo, violet, gray, or any other suitable color or hue, shade, or tone of a color.

As mentioned above, a first color of the printed matter 12 is the same color as a color of the colored material 14. The printed matter 12 can further include at least a second color, wherein the at least second color is a color that is different than the color of the colored material 14. The at least second color is visible behind the colored material 14 when viewed from outside the concealment device 10.

In some embodiments, the colored material 14 may include areas (for example, bars, circles, stripes, or other shapes and configurations) of different colors. In such embodiments, printed matter 12 is concealed when positioned behind the area of the colored material 14 having a color that matches the color of the printed matter and is displayed when positioned behind an area of the colored material having a color that is different than the color of the printed matter.

Figure 1B:
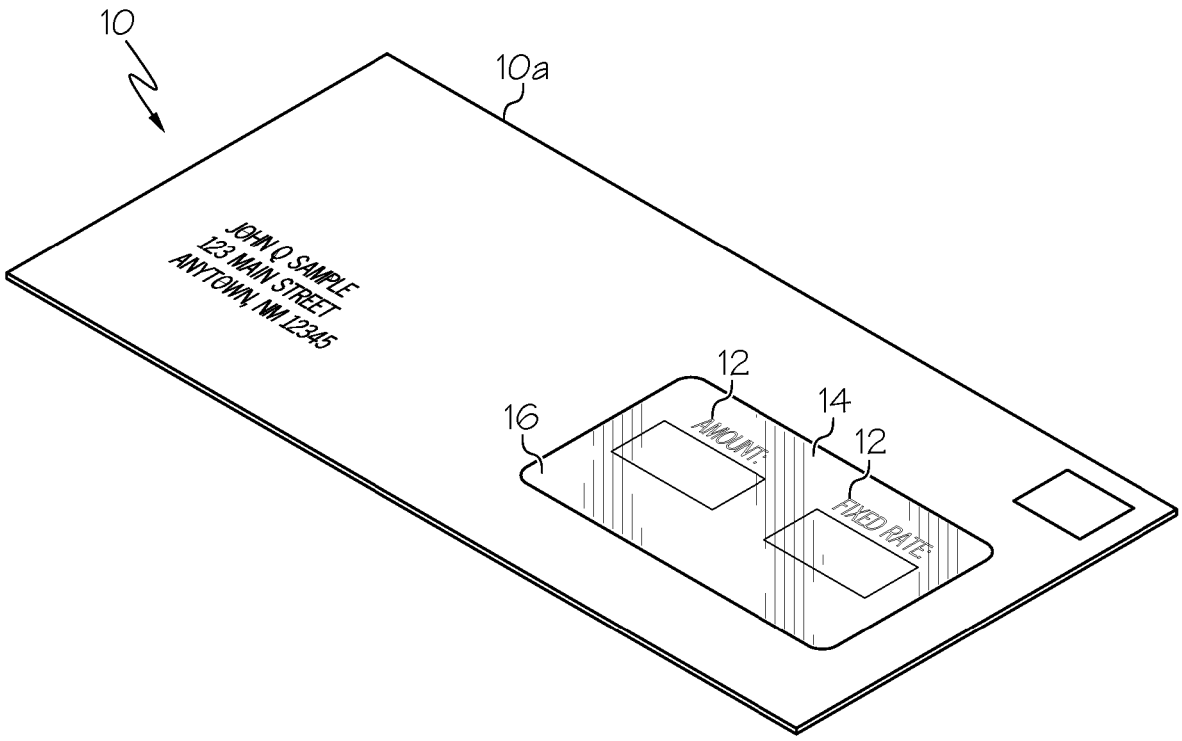
FIG. 1B is a perspective view of the concealment system of FIG. 1A showing a printed item inserted inside the envelope with the printed matter concealed behind the window of the envelope.
Figure 2A:
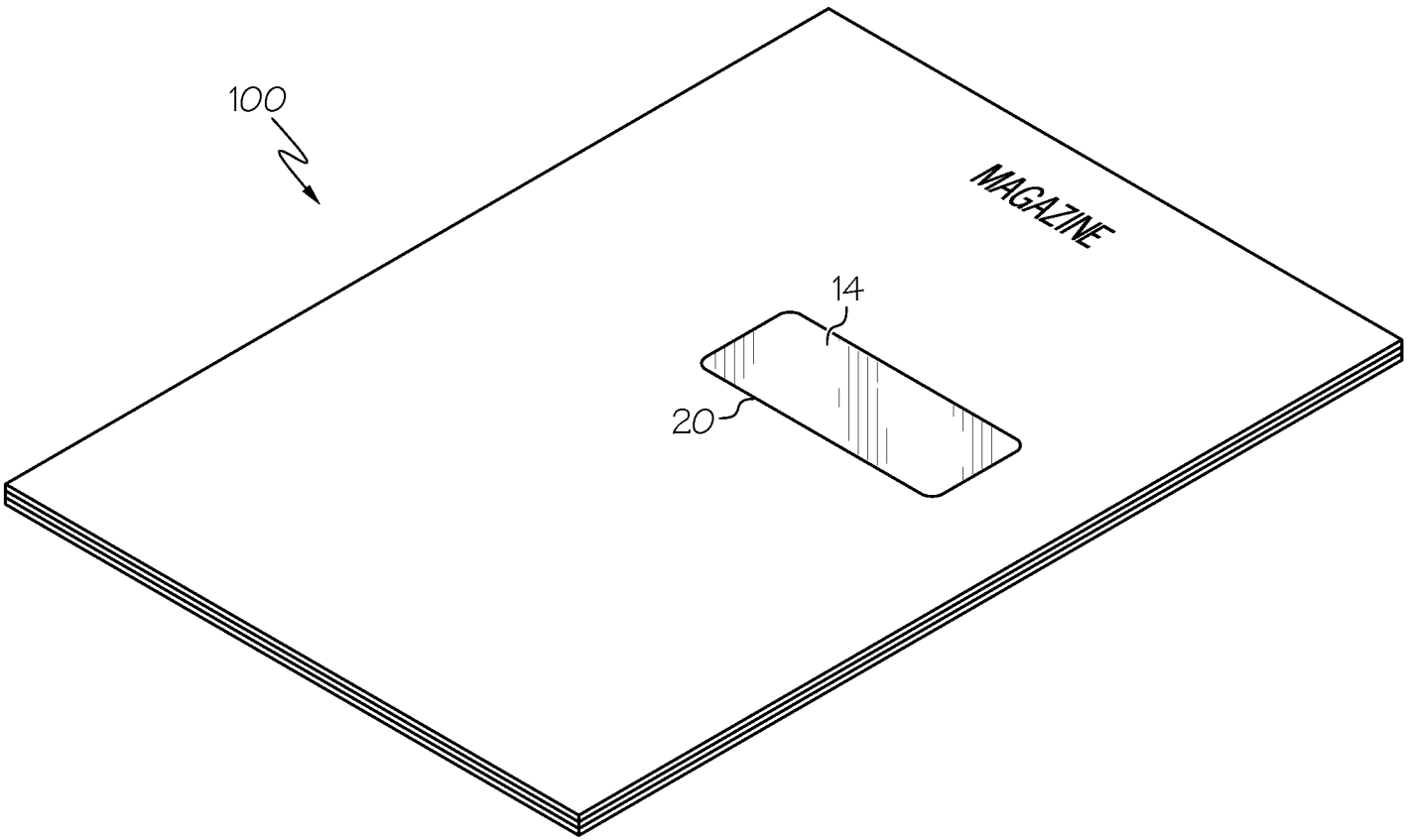
FIG. 2A is a perspective view of a concealment system, wherein the concealment device is a magazine with a window in its front cover.
Figure 2B:
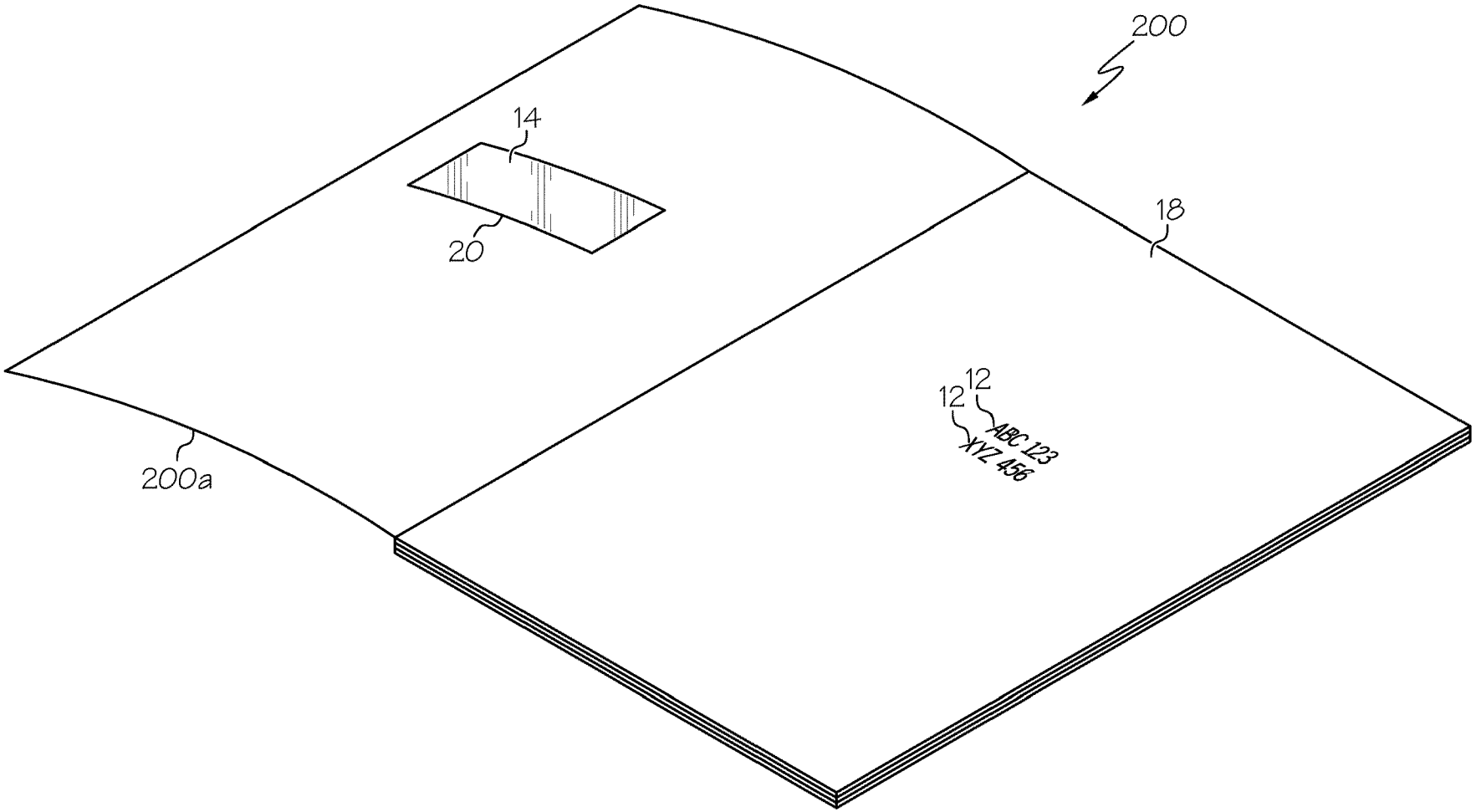
FIG. 2B is a perspective view of the concealment system of FIG. 2B, wherein the front cover of the magazine is opened to reveal the printed matter on a first interior page that was concealed behind the window of colored material when the front cover was closed.

As shown in FIGS. 1A, 1B, 2A, and 2B, the concealment device 10 can be or can include an envelope 10*a*, a magazine 100, or a booklet 200. Examples of an envelope 10*a*, as that term is used herein, include a letter envelope, a package envelope, a mailer, a box, or other type of shipping envelope or package. A magazine 100, as that term is used herein, includes printed magazine periodicals, newspapers, books, and other publications. A booklet 200, as that term is used herein, includes booklets, brochures, flyers, circulars, and greeting cards.

The invention also features a concealment system for covering and concealing printed matter. The concealment system includes the concealment device 10, 100, or 200 as described herein in various embodiments as well as a printed item 16 that includes the printed matter 12, which is concealed by the concealment device.

The printed item 16 can be a paper or other printed document that is insertable into an envelope 10, a page 18 of a magazine 100 or booklet 200, a paper insert or other printed insert that is insertable into a magazine or booklet, or any other object on which printed matter 12 may be printed and which may be inserted into an envelope, a magazine, or a booklet. Although the printed item 16 is described above as being printed, the system and device is also useful for printed items that are imprinted as well as printed items that include printed matter that is both printed and imprinted. The printed item can be printable, imprintable, or both.

The printed matter 12 is printed on a predefined area of the printed item 16, e.g., within an area that fits within the outer boundaries of the colored material when placed behind the colored material so that once configured and placed behind the colored material, the printed matter is concealed by the colored material due to their matching colors. For example, in embodiments in which the concealment device is an envelope, the printed item can be configurable so that the predefined area is viewable through the window when the printed item is covered by the concealment device, thereby displayed the predefined area through the window but concealing the printed matter that is printed thereon in the same color as the color of the colored material. The printed matter can be printed, imprinted, or both.

The printed matter 12 can be or can include alphanumeric text, symbols, photographs, images, designs, or any other matter that can be printed or imprinted. The printed matter 12 can be or can include or identify an advertisement, information, a hint, a clue, a code, a prize, any other data that is desired to be concealed, or a combination of two or more of the foregoing. Printed matter 12 having the same color as the color of the colored material 14 is not visible through the colored material from outside the concealment device 10 but is visible upon uncovering the concealment device from the printed item 16.

In some embodiments, the concealment device 10 can feature a window 20, wherein the window includes the colored material 14 that conceals the printed matter 12. In other embodiments, the entire concealment device 10 or a portion thereof may be constructed from the colored material 14. In still other embodiments, the front cover 200*a* or back cover (or a portion thereof) of a magazine 100 or booklet 200 can be constructed from the colored material 14.

The invention also features a system for concealing printed matter. The system features a concealment device that includes a translucent colored material and a printed item that is coverable by the concealment device. The printed item includes printed matter having a first color that corresponds to a color of the colored material. The printed matter is not visible when viewed through the colored material from outside the concealment device.

In one exemplary embodiment, the concealment device is an envelope having a window capable of concealing a portion of printed matter that is positioned behind the window within a pocket of the envelope in a predefined area that is visible through the window from outside the envelope. The envelope is made from paper, cardboard, foil, or other suitable materials. The envelope's window conceals printed matter printed on the predefined area of an enclosed printed item inserted into the pocket of the envelope. The enclosed printed item can be a letter, flyer, or other paper or advertisement that is inserted or folded and arranged so that its predefined area on which the first portion of printed matter and second portion of printed matter are within outer boundaries of the window.

The window is made of colored material, which is partially or entirely transparent or translucent. The size, shape, and placement of the window on the envelope may vary between embodiments. In most embodiments, the window is located on a front surface or a rear surface of the envelope. The printed matter is printed on the printed item in a color that corresponds to a color of the colored material so that, when the predefined area is aligned with the window, the color of the colored material, which matches the color of the printed matter, renders the printed matter invisible through the window.

In one embodiment, the colored material can be attached to an inner surface of the envelope over an aperture passing through at least one wall of the envelope. In another embodiment, the colored material can be disposed between two sandwiched layers of material that form one or more walls of the envelope so that the colored material covers an aperture passing through at least one wall of the envelope. In still another embodiment, the colored material can be attached to an outer surface of the envelope over an aperture passing through at least one wall of the envelope.

In exemplary embodiments, both the color of the colored material and the color of the printed matter printed on the predefined area of the enclosed item are red. FIG. 1 shows an exemplary embodiment of the envelope in which the majority of the envelope is made from paper and the window is made of red glassine to conceal printed matter printed in red ink on the predefined area of the enclosed item that is contained within the envelope. Red is also a preferred color used in exemplary embodiments due to its ability to attract the attention of a recipient in order to entice the recipient to open the envelope to view the printed matter that is concealed from visibility outside the envelope by the window. The red window will cause the image-bearing sheet (i.e., the enclosed item having the predefined area) within the envelope to be only partially visible through the transparent or semi-opaque window so that the printed matter within the predefined area of the image-bearing sheet is only partially revealed to the extent that its color differs from that of the colored material of the window. In other embodiments, other colors may be used. For example, the color of the window and the color of the printed matter can both be orange, yellow, green, blue, indigo, violet, or any other color that allows the window to render the printed matter printed on the predefined area as invisible to a viewer looking at the window from outside the envelope.

The envelope with concealing window described herein is useful for direct mail advertising; for greeting cards; for envelopes enclosing gift cards, gift certificates, coupons, rewards points, or other gifts, rewards or prizes; and for other types of mailings. In any of these uses the envelope with concealing window may be used to entice the recipient to open the envelope to see what is concealed behind the window inside the envelope.

An outer surface of the envelope (i.e., an outer surface of the paper portion of the envelope) may have printed matter that explains the nature of what is concealed by the window to further entice the recipient to open the envelope to view the enclosed item. For example, a hint or clue may be printed on the outer surface of the envelope concerning the type of information that is concealed behind the colored material of the window.

The terms "print" and "printable," and related variations of those terms, as used herein relate to printing on one or more of the envelope or the enclosed item during manufacturing, or printing on a surface of one or more of those components in a first instance by a manufacturer. The terms "imprint" and "imprintable," and related variations of those terms, as used herein refer to printing on one or more of the envelope or the enclosed item by a user subsequent to manufacturing. Imprinting can be accomplished manually using a pen, pencil, marker, or other handheld writing instrument, or mechanically using a printer or printing device. For example, the user may imprint customizations onto the envelope, the enclosed item, or both in the first instance where the manufacturer has not printed any information on these components during manufacturing, or the user may imprint customizations in a second, third, fourth or other instance onto one or both of the envelope and the enclosed item that includes information printed thereon by the manufacturer during manufacturing. By way of further example, an envelope or enclosed item that includes information printed thereon by the manufacturer during manufacturing is printed in the first instance, customizations subsequently printed onto the component by a user are imprinted in the second instance, and additional information thereafter printed onto the same component by the same user or by another user is imprinted in the third instance. Imprinting of one or both of the envelope and the enclosed item can also be performed by a retailer, an advertiser, or other distributor or sender.

The invention also relates to methods for concealing printed matter using devices and systems as described elsewhere herein. The method includes the steps of providing a printed item that includes printed matter and covering the printed item using a concealment device that includes a translucent colored material. The colored material includes a first color. The printed matter includes a color that corresponds to the first color of the colored material.

The method can also include the step of uncovering the concealment device from the printed item to reveal the printed matter that was concealed beneath the colored material of the concealment device.

In another embodiment, the method can include the step of removing the printed item from the concealment device to reveal the printed matter that was concealed beneath the colored material. In this embodiment, the concealment device can be an envelope into which the printed item is insertable and removable.

Other Embodiments

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

What is claimed is:

1. A system for covering and concealing printed matter, the system comprising:

a printed item comprising printed matter, wherein the printed matter comprises a first printed matter comprising a first color and a second printed matter comprising at least a second color that is different than the first color;

a concealment device comprising a translucent colored concealment material comprising a concealing color; wherein the concealment material covers the printed matter; wherein the concealment material conceals the first printed matter but does not conceal the second printed matter when the concealment material is placed in front of the printed matter; wherein the second printed matter is not concealed when not covered by the concealment material; wherein the concealing color of the concealment material corresponds to the first color of the first printed matter that is configured inside or behind the concealment device so as to be positioned adjacent to and beneath the concealment material but is different than the at least second color of the second printed matter; wherein the concealment material is removable from in front of the printed matter to reveal the first printed matter; and wherein the first printed matter comprises alphanumeric text that is concealed from reading or viewing when placed behind the concealment material and revealed for reading or viewing when the concealment material is removed from in front thereof.

2. The system of claim 1, further comprising a window, wherein the window comprises the concealment material that conceals the first printed matter.

3. The system of claim 2, wherein the first printed matter is printed on a predefined area of the printed item.

4. The system of claim 3, wherein the printed item is configurable so that the predefined area is viewable through the window when the printed item is covered by the concealment device.

5. The system of claim 1, wherein the concealment material is red and the first color of the first printed matter is also red.

6. The system of claim 1, wherein the second printed matter is visible behind the concealment material when viewed from outside the concealment device.

7. The system of claim 1, wherein the printed matter comprises text or an image, wherein the first printed matter is not visible through the concealment material from outside the concealment device but is visible upon uncovering the concealment device from the printed item.

8. The system of claim 1, wherein the printed matter further comprises one or more symbols, photographs, images, designs, or a combination of two or more of the foregoing.

9. A system for concealing printed matter, the system comprising:

a concealment device comprising a translucent concealment material; and a printed item that is coverable by the concealment device, wherein the printed item comprises printed matter; wherein the printed matter comprises a first printed matter comprising a first color and a second printed matter comprising at least a second color that is different than the first color; wherein the printed matter comprises a first printed matter comprising a first color; wherein the first color of the first printed matter corresponds to a color of the concealment material; wherein the concealment material conceals the first printed matter when the concealment material is placed in front of the first printed matter; wherein the second printed matter is not concealed when not covered by the concealment material; and wherein the concealment material conceals and renders the first printed matter not visible when placed in front thereof and the concealment material is removable to render the first printed matter visible when not viewed through the concealment material; and wherein the first printed matter comprises alphanumeric text that is concealed from reading or viewing when placed behind the concealment material and revealed for reading or viewing when the concealment material is removed from in front thereof.

10. The system of claim 9, wherein the concealment device comprises a window and the window comprises the concealment material that conceals the first printed matter.

11. The system of claim 10, wherein the first printed matter is printed on a predefined area of the printed item.

12. The system of claim 11, wherein the printed item is configurable so that the predefined area is viewable through the window when the printed item is covered by the concealment device.

13. The system of claim 9, wherein the concealment material is red and the first color of the first printed matter is also red.

14. The system of claim 9, wherein the printed matter further comprises a second printed matter comprising at least a second color; wherein the at least second color is a color that is different than the color of the concealment material and the first color of the first printed matter; and wherein the second printed matter is visible behind the concealment material when viewed from outside the concealment device.

15. The system of claim 9, wherein the printed matter comprises text or an image, wherein the first printed matter is not visible through the concealment material from outside the concealment device but is visible upon uncovering the concealment device from the printed item.

16. The system of claim 9, wherein the printed matter further comprises one or more symbols, photographs, images, designs, or a combination of two or more of the foregoing.

17. A method for concealing printed matter, the method comprising the steps of:

(a) providing a printed item comprising printed matter, wherein the printed matter comprises a first printed matter comprising a first color and a second printed matter comprising at least a second color that is different than the first color; and (b) covering the first printed matter of the printed item using a concealment device that comprises a translucent concealment material, wherein the concealment material comprises a first color;

wherein the first color of the first printed matter comprises corresponds to the first color of the concealment material;

wherein the concealment material conceals the first printed matter when the concealment material is placed in front of the first printed matter;

wherein the second printed matter is not concealed when not covered by the concealment material;

wherein the concealment material conceals and renders the first printed matter not visible when placed in front thereof and the concealment material is removable to render the first printed matter visible when not viewed through the concealment material; and wherein the first printed matter comprises alphanumeric text that is concealed from reading or viewing when placed behind the concealment material and revealed for reading or viewing when the concealment material is removed from in front thereof.

18. The method of claim 17, wherein the concealment device comprises a window and the window comprises the concealment material that conceals the first printed matter.

19. The method of claim 18, wherein the first printed matter is printed on a predefined area of the printed item, wherein the printed item is configurable so that the predefined area is viewable through the window when the printed item is covered by the concealment device.

20. The method of claim 17, further comprising at least one of the following steps:

(c) uncovering the concealment device from the printed item to reveal the first printed matter that was concealed beneath the concealment material of the concealment device; and (d) removing the printed item from the concealment device to reveal the first printed matter that was concealed beneath the concealment material, wherein the concealment device comprises an envelope into which the printed item is insertable and removable.

21. The method of claim 17, wherein the concealment material is red and the first color of the first printed matter is also red.

22. The method of claim 17, wherein the at least second color is a color that is different than the color of the concealment material; and wherein the second printed matter is visible behind the concealment material when viewed from outside the concealment device.

* * * * *